US007793376B2

(12) United States Patent
Rush, Sr. et al.

(10) Patent No.: US 7,793,376 B2
(45) Date of Patent: Sep. 14, 2010

(54) TRUCK MOUNTED ROTATING BROOM SYSTEM

(76) Inventors: John Conaway Rush, Sr., 1720 Scarborough La., Pasadena, TX (US) 77502; Timothy Dwayne Teague, 106 W. Center, Eagle Lake, TX (US) 77434

( * ) Notice: Subject to any disclaimer, the term of this patent is extended or adjusted under 35 U.S.C. 154(b) by 1897 days.

(21) Appl. No.: 10/648,901

(22) Filed: Aug. 27, 2003

(65) Prior Publication Data

US 2004/0040103 A1 Mar. 4, 2004

Related U.S. Application Data

(60) Provisional application No. 60/407,209, filed on Aug. 30, 2002.

(51) Int. Cl.
*E01H 1/05* (2006.01)

(52) U.S. Cl. ..... 15/82; 15/52.1

(58) Field of Classification Search ..... 15/50.3, 15/52.1, 82, 87
See application file for complete search history.

(56) References Cited

U.S. PATENT DOCUMENTS

| | | | | | |
|---|---|---|---|---|---|
| 2,711,551 | A * | 6/1955 | Wagner et al. | ..... | 15/82 |
| 3,837,030 | A * | 9/1974 | Liebrecht | ..... | 15/82 |
| 4,160,302 | A * | 7/1979 | Hirst et al. | ..... | 15/347 |
| 4,811,442 | A * | 3/1989 | Barker | ..... | 15/82 |
| 6,035,478 | A * | 3/2000 | Miller et al. | ..... | 15/82 |
| 6,446,297 | B1 * | 9/2002 | Jackson | ..... | 15/82 |
| 6,618,888 | B2 * | 9/2003 | Joynt et al. | ..... | 15/49.1 |
| 6,622,336 | B2 * | 9/2003 | Jackson | ..... | 15/82 |
| 6,675,424 | B2 * | 1/2004 | Smith et al. | ..... | 15/87 |
| 6,802,098 | B2 * | 10/2004 | Geyer et al. | ..... | 15/52.1 |
| RE38,973 | E * | 2/2006 | Smith | ..... | 15/82 |
| 2002/0184721 | A1 * | 12/2002 | Jackson | ..... | 15/82 |

FOREIGN PATENT DOCUMENTS

| | | | |
|---|---|---|---|
| CH | 679317 | * | 1/1992 |
| DE | 3643080 | * | 6/1988 |

* cited by examiner

*Primary Examiner*—Randall Chin
(74) *Attorney, Agent, or Firm*—Jones Day; Garry J. Tuma

(57) ABSTRACT

A rotating broom system to be installed on the front of a self-propelled vehicle such as a truck used for the high speed sweeping and removal of snow or debris from paved surfaces such as airport runways assembly has two major components: a rotating broom drive assembly, and a support structure. The rotating broom assembly is connected to the support structure using a non-rigid connection.

9 Claims, 7 Drawing Sheets

TRUCK MOUNTED ROTATING BROOM SYSTEM

REFERENCE TO RELATED APPLICATION

This application claims the benefit of Provisional U.S. patent application Ser. No. 60/407,209 filed Aug. 30, 2002.

FIELD

The present invention is a system for mounting, positioning, and powering a rotating broom; more particularly, the present invention is a system for mounting, positioning, and powering a rotating broom to be installed on the front of a self-propelled vehicle such as a truck. The truck-mounted system for mounting, positioning, and powering a rotating broom is used for the high speed sweeping and removal of snow or debris from large paved surfaces such as airport runways.

BACKGROUND

The absence of snow or debris from large paved surfaces, particularly airport runways, is essential for tire traction which assures the safe passage of a vehicle, particularly a high speed vehicle such as an airplane, over the paved surface. Accordingly, operators of airports and those who maintain the surface condition of large paved surfaces have found it effective to sweep such large paved surfaces to remove buildups of snow or debris. To minimize the time required to perform sweeping operations, it has become an accepted practice to use large rotating brooms. These large rotating brooms are moved over the large paved surface by being mounted on the front of or being towed behind a truck. In the U.S., the preference has been to mount a rotating broom to the front of the truck so that the truck driver can observe the direction in which the truck is headed and, at the same time, observe the effectiveness of the sweeping operation.

The use of snow or debris removal devices mounted on the front of trucks to remove fallen snow or debris from large paved surfaces is not a new one, as snow plows have been mounted to the front of self-propelled trucks almost as long as there have been self-propelled trucks. When rotating brooms were determined to be effective in removing accumulations of snow and accumulations of debris from large paved surfaces, such rotating brooms were mounted to the front of trucks in a manner similar the mounting of snow plows. Specifically, the mounting hardware was connected primarily to either the truck's front bumper, the forward portion of the truck's frame, or both. While the front bumper and the forward portion of the truck's frame are effective for holding the rotating broom, its mounting hardware, and its powering equipment, the impact of this heavy weight on the safe handling of the truck was often overlooked. Because the rotating broom, its mounting hardware, and its powering equipment were positioned further away from the front of the truck to enable angular repositioning of the rotating broom for directing the path of swept snow or debris to one side of the truck, the negative effects of the weight of the rotating broom on the drivability of the truck were exacerbated. Specifically, under certain conditions, some drivers of trucks with rotating broom systems mounted thereon noticed substantial leaning of the truck to one side or another.

One solution to the negative effects on the drivability of the truck from the weight of a rotating broom system mounted to the front thereof was to place a caster system under the rotating broom system to reduce the amount of weight transferred directly to the truck. While such caster systems were effective in modifying weight distribution, the use of a caster system near the rotating broom created new problems in controlling broom direction and in maintaining sweeping quality. One cause of these problems is the fact that the bristles of the rotating broom continually shorten during sweeping operations. Solutions to the problem of the negative effects on the drivability of the truck have included adding counterbalance weight or using complex hydraulic control systems to both position or control the operation of the rotating broom and improve the drivability of the truck. Such systems have only demonstrated limited effectiveness, and the problems associated with drivability control remain.

Accordingly, a need remains for a robust system to mount a rotating broom system to the front of a truck so that there will be no negative impact on the drivability of the truck or detraction from the effectiveness of the sweeping operation.

SUMMARY

The disclosed system for mounting, positioning, and powering a truck-mounted rotating broom system of the present invention substantially reduces the negative impact of the weight of the rotating broom system on the drivability of the truck, while not reducing the effectiveness of the sweeping operation. Included in the disclosed system are two major components: a rotating broom mounting and control assembly, and a support structure. These two major components are connected by a non-rigid connection.

The rotating broom mounting and control assembly portion of the present invention, which is attached to the front of the non-rigid connection, includes those sub-systems necessary to position and turn the rotating broom. Such sub-systems assure that the necessary bristle tip speed with respect to the paved surface is maintained for effective removal of snow or debris from the paved surface.

The support structure portion of the present invention on the opposite side of the non-rigid connection from the rotating broom mounting and control assembly includes a substantially stationary gooseneck assembly. The substantially stationary gooseneck assembly allows center point sweeping to the left or to the right of the self-propelled vehicle. The support structure further includes a swinging trunnion assembly which provides center point oscillation of the rotating broom assembly.

The combination of the center point oscillation and the non-rigid connection therebetween allows for vertical tracking of the rotating broom and continuous adjustment of the rotating broom to the various conditions encountered on the paved surface being swept. The use of a stationary gooseneck, assembly, a swinging trunnion assembly, and a non-rigid connection therebetween provides superior performance characteristics over prior art truck-mounted rotating broom sweeping systems.

The support structure portion of the truck-mounted system of the present invention, by using the unique combination of a stationary gooseneck assembly and a swinging trunnion assembly, when combined with a non-rigid connection therebetween, provides the kinematics necessary for optimizing both the sweeping effectiveness of the rotating broom and the safe operation of the truck. In addition, the disclosed system for mounting, positioning, and powering a rotating broom allows for easy and reliable changing of the angular orientation of the rotating broom; that is, swinging the entire rotating broom to either the left or to the right with respect to the front of the truck, by center oscillation of the yoke which supports the rotating broom.

The disclosed truck-mounted system for mounting, positioning, and powering a rotating broom segregates the weight of the rotating broom system into two separate sections. The first section, the weight of the rotating broom along with its drive assembly, is supported by pneumatic tire casters. The second section, the weight of the support structure, is supported by the self-propelled vehicle itself. In addition, the design of the truck-mounted system for mounting, positioning, and powering a rotating broom permits rotating brooms of different diameters to be easily and quickly installed by simply interchanging the broom pivot arms and then assembling the rotating broom with the desired diameter together with the appropriate hydraulic drive components.

The center point movement of the truck-mounted system for mounting, positioning, and powering a rotating broom about its axis allows the broom bristles to have a consistent contact pattern with the ground. Consistency of broom bristle contact pattern with the ground is a problem with prior art designs. The rotating broom mounting system of the present invention also reduces the negative impact on the drivability of the truck; specifically, vehicle lean caused by unequal loading on the vehicle's suspension. The disclosed truck-mounted rotating broom system provides weight transfer to the vehicle without the need for counterweights or special hydraulics.

BRIEF DESCRIPTION OF THE DRAWING FIGURES

A better understanding of the disclosed truck-mounted system for mounting, positioning, and powering a rotating broom is included in the following drawing figures, wherein.

DESCRIPTION OF THE EMBODIMENTS

Figure 1:
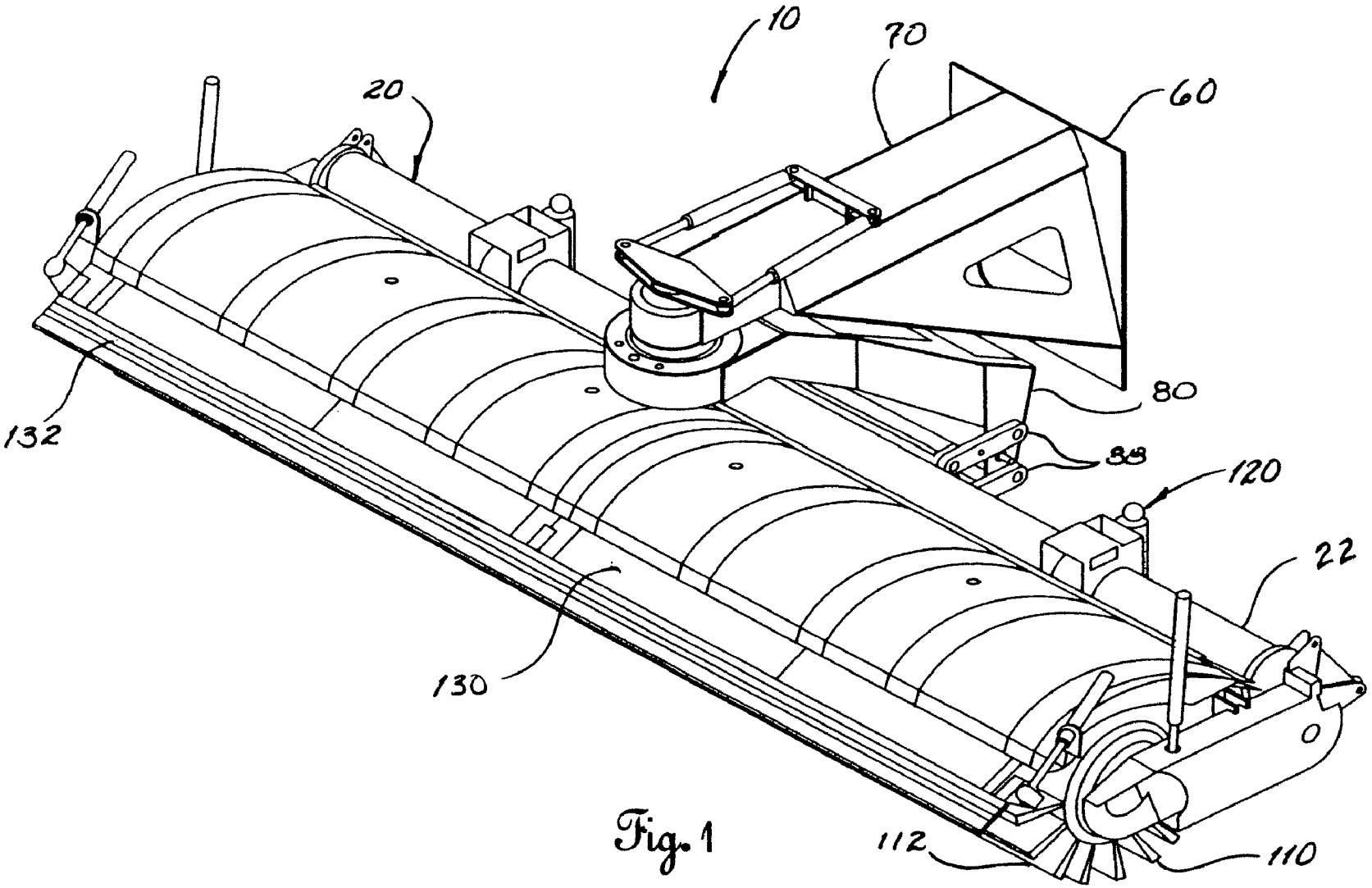
FIG. 1 is a perspective view of the truck mounted rotating broom system of the present invention.

An introduction to a better understanding of the truck mounted rotating broom system 10 for mounting, positioning, and powering a rotating broom of the present invention may be had by appreciating the large size of the rotating broom 110 that is used with the present invention for sweeping a paved surface. While rotating brooms 110 come in a variety of different sizes and the present invention is not limited by the size of the rotating broom 110, the preferred embodiment of the present invention was constructed for mounting a substantially cylindrical rotating broom 110 having a diameter from substantially three feet to a diameter of substantially four feet. The length of the substantially cylindrical rotating broom 110 is about eighteen feet. This eighteen foot broom is turned at speeds varying from 550 rpm to 800 rpm while the truck (not shown) used to move the rotating broom 110 over the paved surface to be swept is traveling at speeds of up to 35 mph.

While many substantially cylindrical rotating brooms use circular disks of bristles aligned across the length of the rotating broom, the preferred embodiment of the disclosed system uses cassettes of linear groups of bristles 112. These cassettes of linear groups of bristles 112 are inserted into holders (not shown) which are to be mounted parallel to the long axis of the rotating broom 110. The power to turn the substantially circular rotating broom is provided by any one of a variety of well known means, generally located on one or both ends of the rotating broom 110. A hydrostatic pump and motor combination, where the hydrostatic pump is driven by the truck's engine and the motor is mounted in the broom pivot arm, is used in the preferred embodiment to provide the necessary power to turn the rotating broom 110. Those of ordinary skill in the art will understand that both the selection of and the position for the drive components necessary to turn the rotating broom may be affected by a wide variety of design and operational considerations.

The design of the disclosed truck-mounted system for mounting, positioning, and powering a rotating broom solves a variety of interdependent problems. Starting with the tip speed at the end of each of the broom bristles, the effective uniform sweeping of a paved surface requires even contact of the end of the broom bristles across the full length or span of the rotating broom 110. Complicating this initial requirement for even contact of the bristle tips 114 with the paved surface is the coning of the shape of the substantially cylindrical rotating broom 110 from uneven wear patterns caused by a variety of factors, including differing terrain conditions. As will be understood by those of ordinary skill in the art, the disclosed system can accommodate the coning of the shape of the substantially cylindrical rotating broom 110.

Those familiar with the sweeping of paved surfaces, particularly airport runways, realize that when the truck reaches the end of the runway, the angular orientation of the rotating broom 110 must be changed to assure that the snow or debris continues to be displaced in the same direction off the runway or paved surface. In addition, the paved surface may be part smooth concrete, part smooth asphalt, and/or part rough asphalt. Accordingly, the truck mounted rotating broom system 10 for mounting, positioning, and powering a rotating broom 110 of the present invention provides a constant pattern of contact of the tips 114 of the bristles 112 with the paved surface, irrespective of the angular orientation of the rotating broom 110 with respect to the direction of travel of the truck or irregularities in the paved surface.

While there may be some sweeping situations in which the long axis of the rotating broom assembly is substantially perpendicular to the long axis of the truck, most sweeping situations require that the long axis of the rotating broom 110 be angled up to 35 degrees away from the direction of travel of the truck. To minimize any negative effects on the handling characteristics of the truck, the point of rotation of the long rotating broom 110 is located on the centerline of the truck chassis. This placement of the point of rotation of the long rotating broom 110 on the centerline of the truck chassis facilitates aligning the vehicle with the long axis of the paved surface being swept, particularly when the angular orientation of the long rotating broom is moved from left to right at the end of a sweeping run.

The management of the weight of the truck-mounted rotating broom system 10 for mounting, positioning, and powering a rotating broom 110, together with its drive components, is the distinguishing feature of the present invention. If all of the weight of the rotating broom mounting hardware and drive mechanism were hung from the front bumper or from the front of the truck frame, the center of gravity of the truck would shift dramatically forward. Such a dramatic forward shift in the center of gravity would place inordinate loads on the front suspension, steering system, and front tires. If a caster system is added to bear the weight of the rotating broom along with its mounting componentry and drive system, a slight mispositioning of the caster wheels would reduce the load on the suspension, steering system, and front tires of the truck. If reduced too much, such reduction in load on the front suspension, steering, and front tires would make the truck more difficult to control.

Even if the caster system is set up properly at the beginning of a sweeping run, the change in broom diameter because of bristle wear will distort the force geometry of the rotating broom sweeping system and thereby cause a change in the weight distribution on the front wheels of the truck, particularly the front axle assemblies.

The need to be able to easily modify the sweeping system for different sized brooms for different sweeping applications is also met by the present invention.

A still better understanding of the present system may be had by understanding, on a macro level, that the foregoing advantages of the disclosed system are obtained by segregating the weight of the truck-mounted system for mounting, positioning, and powering a rotating broom into two sections. The first section is the weight of the substantially cylindrical rotating broom itself, its mounting componentry, and the power system which causes the long rotating broom to turn so that the tips 114 of the bristles 112 move against the paved surface being swept. The second weight section is the structure connected to the truck which supports the weight of the long rotating broom, the mounting componentry, and the power system which causes the broom to rotate.

The first section, or the weight of the rotating broom itself, the mounting componentry, and the power system which causes the rotating broom assembly to turn are supported by a caster system 120. The caster system 120 includes pneumatic tires 122 and an anti-wobble system (not shown). The anti-wobble system reduces the tendency of the caster wheels 122 to move back and forth rapidly during sweeping runs and thereby not track smoothly behind the long substantially cylindrical rotating broom 110.

The second section of the weight is the support structure that is the part of the system supported by the chassis of the truck. As compared to prior art truck-mounted rotating broom systems, the segregation of the weight into two sections by the present invention provides distinct advantages. First, the weight supported by the caster system 120 is significantly reduced as compared to prior art truck-mounted rotating broom systems. Second, the weight supported by the chassis of the vehicle remains relatively constant during a sweeping operation. This relatively constant supported weight assures that a controlled amount of weight is felt by the front axles of the truck. Control of the weight on the front axles of the truck assures better drivability and safe handling. In addition, the disclosed system facilitates changing brooms to brooms having different diameters, bristle composition, or bristle patterns.

Figure 2:
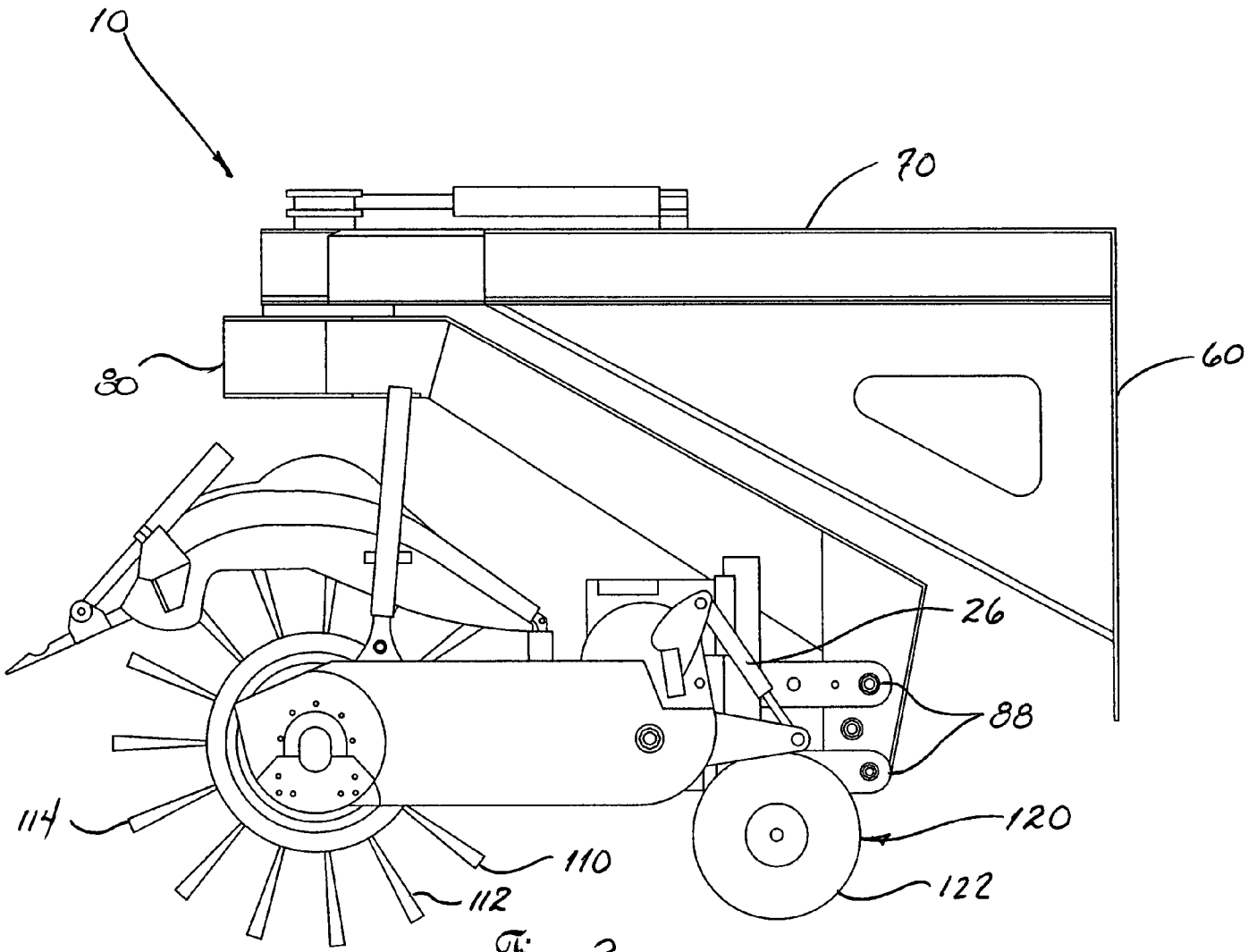
FIG. 2 is a side elevational view of the system shown in FIG. 1.

A still better understanding of the present invention may be had by reference to FIGS. 1 and 2, which show the assembled system, including the rotating broom control assembly 20 and the support structure 60 as they are mounted to the front of a vehicle. The main parts of the support structure include the substantially stationary gooseneck assembly 70 which mounts to the front of the truck, and the swinging trunnion assembly 80 which swings about a vertical axis and is positioned below the stationary gooseneck assembly 70.

A non-rigid connection 88 including floating beam assembly 90 is located on the bottom of the swinging trunnion assembly 80.

The main component of the rotating broom control assembly 20 includes the mounting arm assembly or yoke 22 for the long, substantially cylindrical rotating broom 110 mounted to the floating beam assembly 90 of the non-load bearing connection 88.

Figure 3:
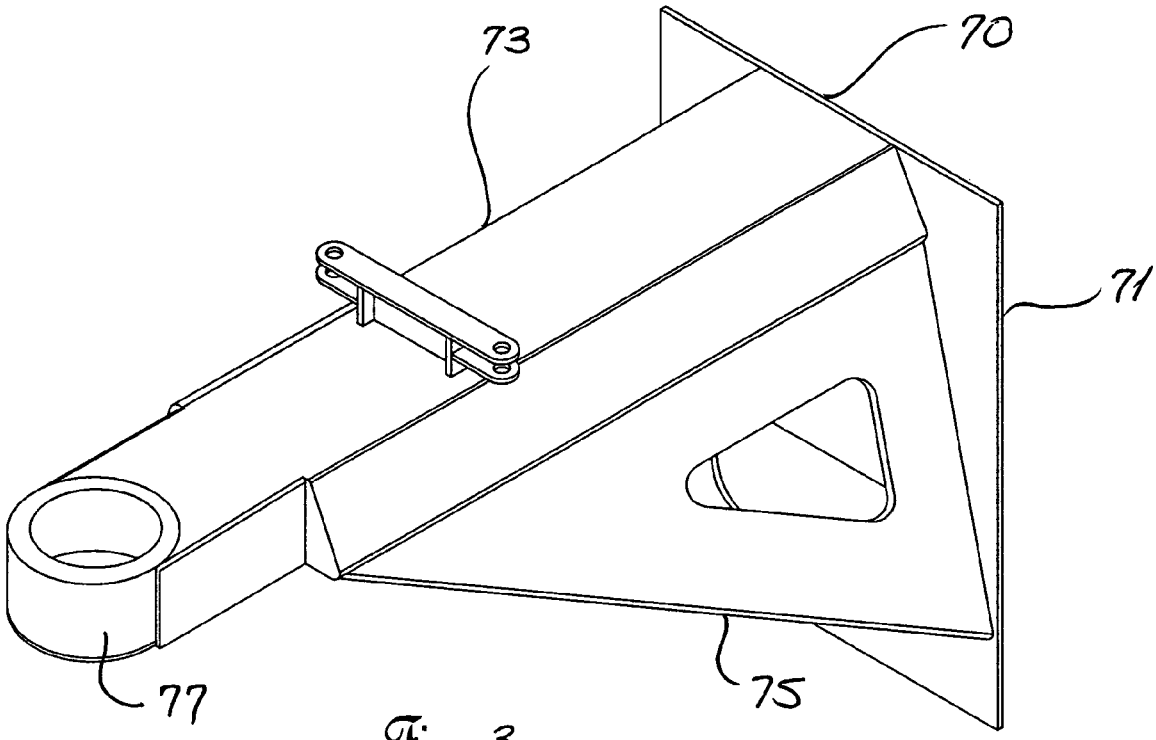
FIG. 3 is a perspective view of the substantially stationary gooseneck assembly.

As shown in FIG. 3, the substantially stationary gooseneck assembly 70 includes a plate 71 for attachment to the front of the truck. Extending outwardly from the plate 71 is a support arm 73 connected by structural gussets 75 located on either side of the plate 71. At the end of the support arm 73 is a ring 77 whose use will be explained below.

Figure 4:
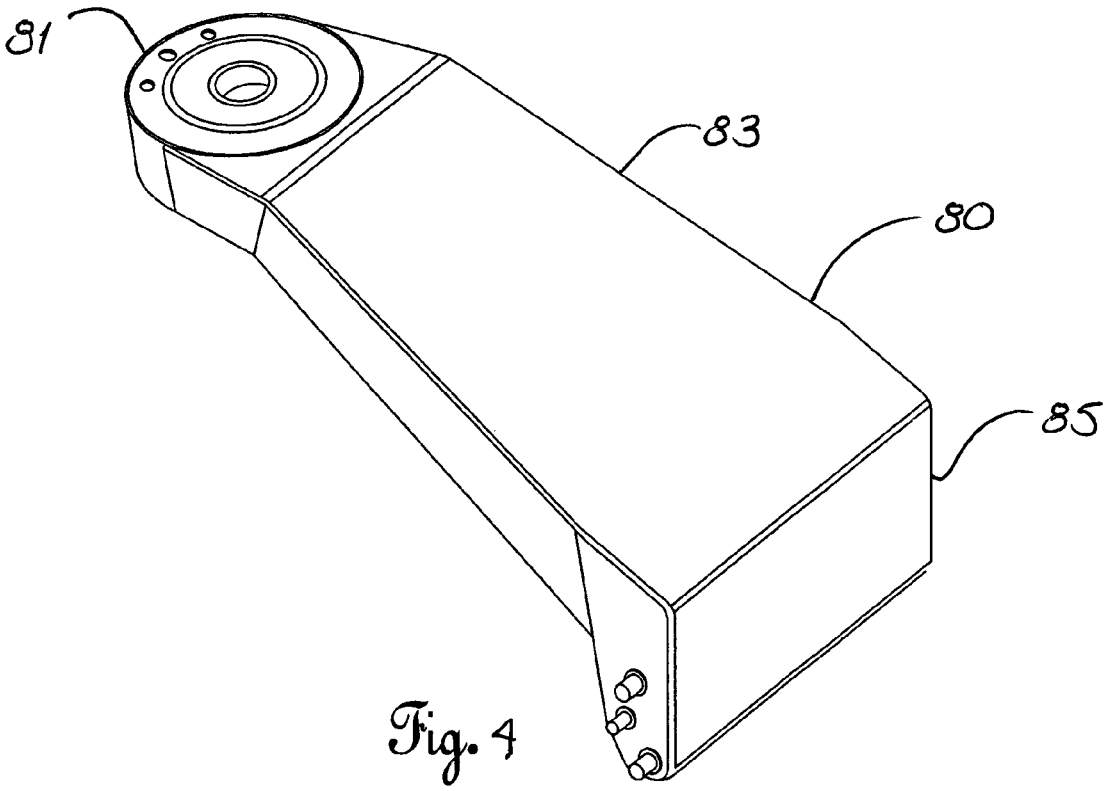
FIG. 4 is a perspective view of the swinging trunnion assembly.
Figure 6A:
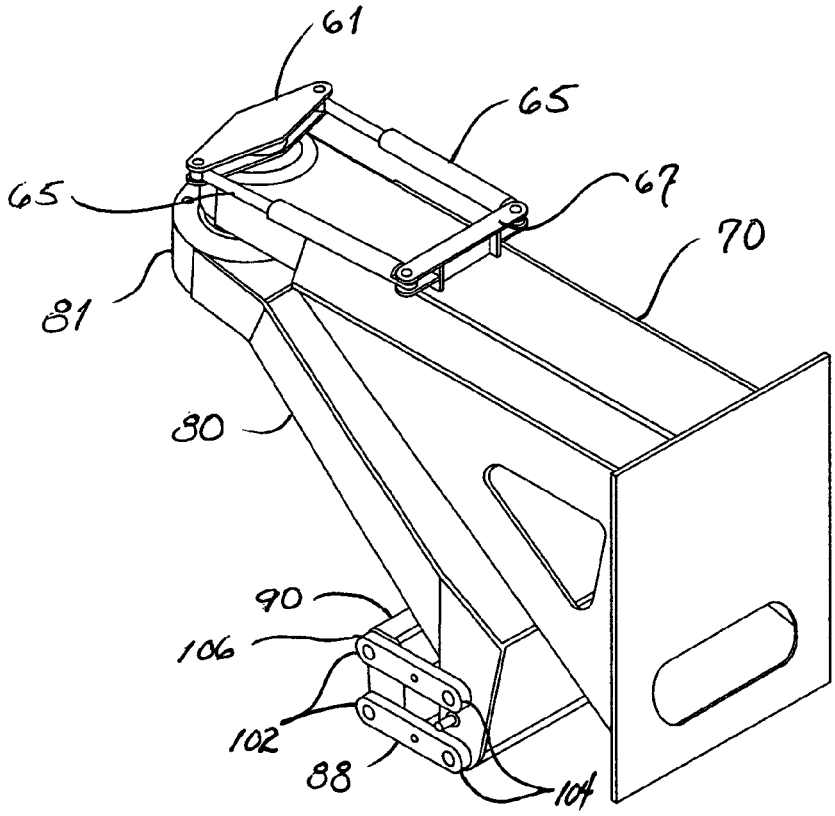
FIG. 6A is a rear perspective view of the combination of the substantially stationary gooseneck assembly, the swinging trunnion assembly, and the non-load bearing floating beam assembly.
Figure 6B:
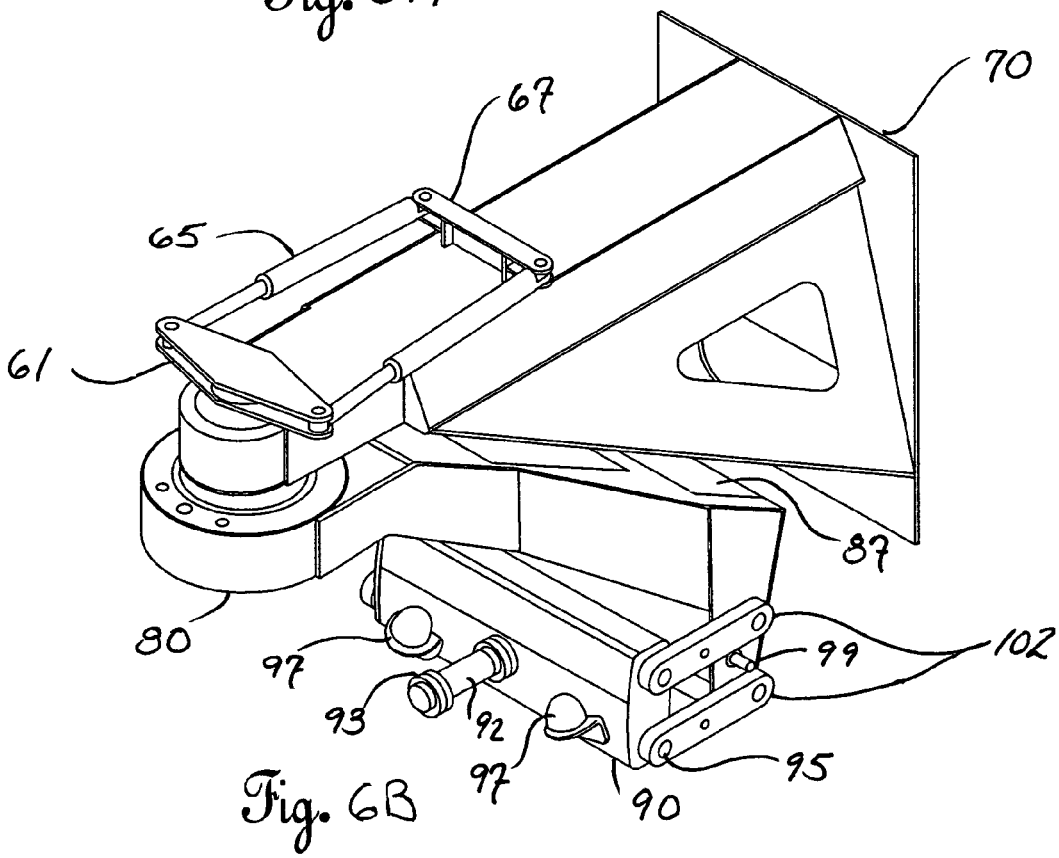
FIG. 6B is a front perspective view of the combination of assemblies shown in FIG. 6A.

Located just below the stationary gooseneck assembly 70 and as shown in FIG. 4 is the swinging trunnion assembly 80. At the outboard end of the swinging trunnion assembly 80 is a circular portion 81 whose utility for attachment to the stationary gooseneck assembly 70 will be explained below. Extending downwardly and at an angle from the circular portion 81 of the swinging trunnion assembly 80 is a support beam 83 which terminates in a mounting plate 85 for the non-rigid connection 88. As shown in FIG. 6B, optional access plates 87 may be placed on top of the support beam 83.

Figure 5:
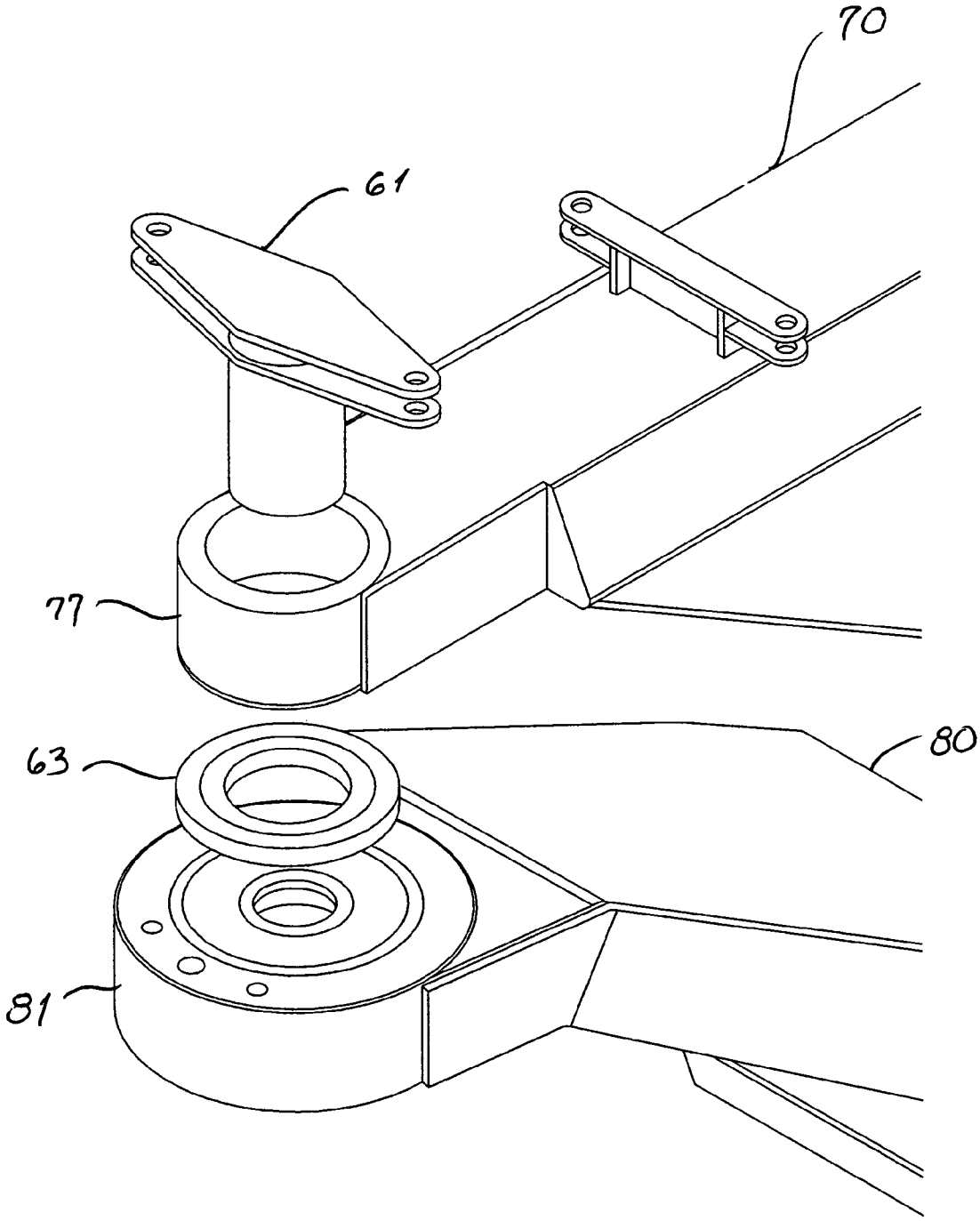
FIG. 5 is an exploded perspective view of the connection of the stationary gooseneck assembly to the swinging trunnion assembly.

The connection of the swinging trunnion assembly 80 to the stationary gooseneck assembly 70 is shown in FIG. 5. A steering yoke 61 passes through the ring 77 at the end of the stationary gooseneck assembly 70 into the circular portion 81 at the end of the swinging trunnion assembly 80. To facilitate the rotation of the swinging trunnion assembly 80 with respect to the stationary gooseneck assembly 70, a swing bearing 63 is placed between the stationary gooseneck assembly 70 and the swinging trunnion assembly 80. Movement of the swinging trunnion assembly 80 with respect to the stationary gooseneck assembly 70 is accomplished by the use of two linear steering cylinders 65, as shown in FIG. 6A. Each of the two linear steering cylinders 65 is attached to the steering yoke 61. The steering yoke 61 is rigidly affixed to the swinging trunnion assembly 80 and to a mounting bracket 67 positioned on the top of the support arm 73 of the stationary gooseneck assembly 70. Thus, when one of the two linear steering cylinders 65 is caused to extend in length and the other is caused to contract in length, the swinging trunnion assembly 80 will swing about a vertical axis with respect to the stationary gooseneck assembly 70.

As previously indicated, the bottom of the swinging trunnion assembly 80 includes a non-rigid connection system 88 including a floating beam assembly 90. This multi-directional, non-load bearing connection system 88 for the floating beam 90 assembly includes a four bar linkage connection 102 in the preferred embodiment The four bar 102 linkage connection shown includes two bars on each side; however, other numbers of bars may be used.

The inner ends 104 of the four bars 102 are pivotably connected to the end of the swinging trunnion assembly 80, and the outer ends 106 of the four bars 102 are pivotably connected to the floating beam 90 as shown in FIG. 6B. Oscillation bearings 93 on shaft 92 facilitate the pivoting action of the rotating broom 110. Because of the criticality of this connection to the operability of the disclosed invention, the preferred embodiment of the non-rigid connection 88 incorporates a sealed spherical bearing 95 at each end of the linkage bars 102.

As shown in FIG. 6B, the front of the floating beam 90 includes oscillation stops 97 for positioning of the long rotating broom. As shown in FIG. 6B, rubber float stops 99 control the up and down movement of the rotating broom 110.

Those of ordinary skill in the art will understand that the foregoing construction provides a substantially rigid support system whose weight is supported by the truck. This substantially rigid support system includes the stationary gooseneck assembly 70 and the swinging trunnion assembly 80. It is the use of the non-load bearing connection 88 to connect the floating beam assembly 90 which enables the weight of the rotating broom control assembly 20, including the mounting componentry and the drive mechanism to be managed separately from the weight of the support system 60.

Figure 7:
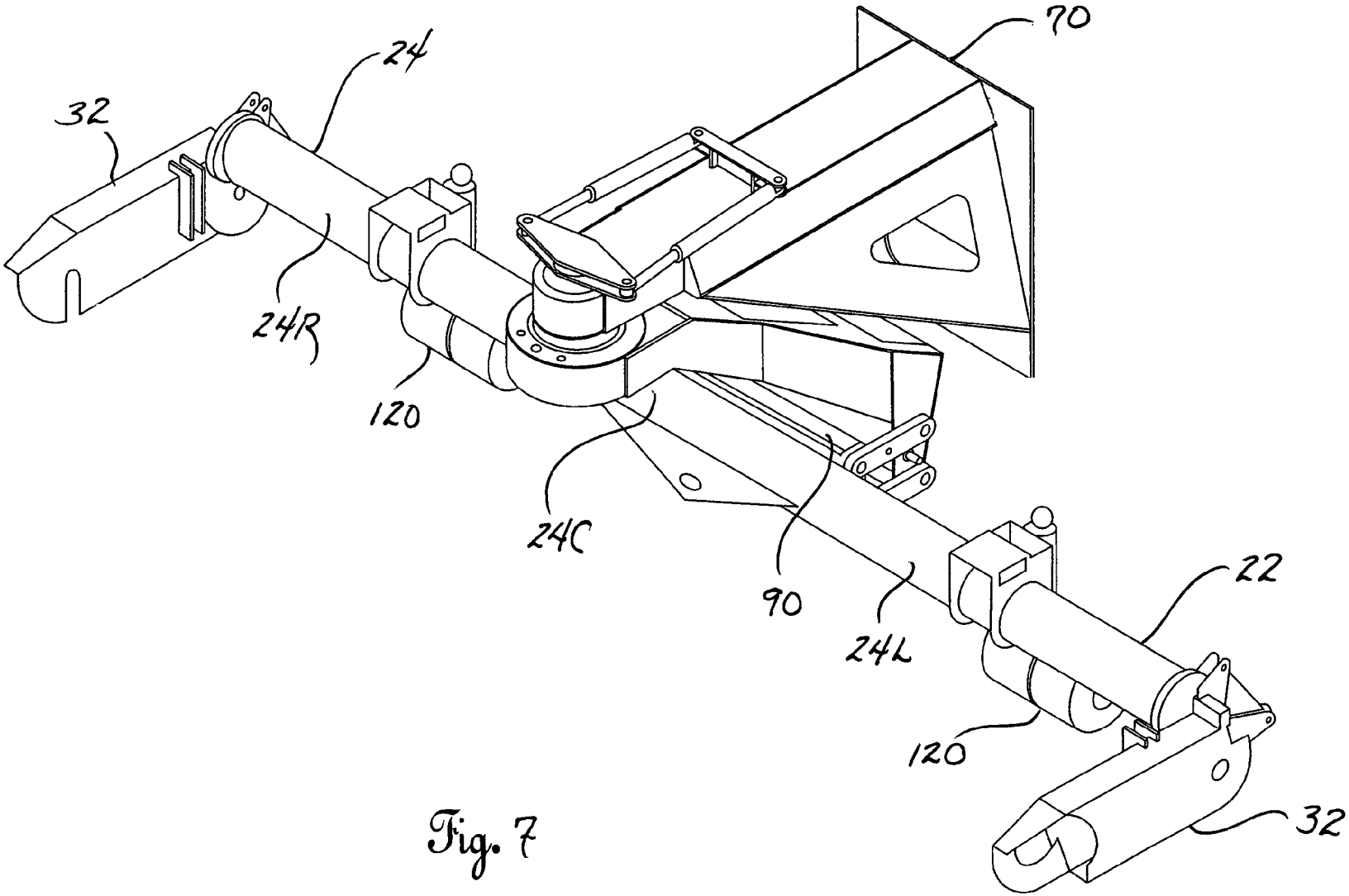
FIG. 7 is a front perspective view of the rotating broom control mounting assembly connected to the combination of assemblies shown in FIGS. 6A and 6B.

As shown in FIG. 7, a yoke 22 for holding the rotating broom 110 and its drive system is attached to the floating beam assembly 90. Tilt of the yoke 22 with respect to the floating beam assembly 90 is about the shaft 92 previously described. The yoke 22 consists of a long beam 24 attached to the floating beam assembly 90. The long beam 24 includes a left portion 24L, a right portion 24R, and a center portion 24C. At both ends of the left portion and the right portion of the long beam 24 is located a rotating pivot arm 32 for the rotating broom 110. This rotating pivot arm 32 permits the long axis of the rotating broom 110 to move up and down with respect to the long beam 24. The position of the rotating pivot arms 32 on each end of the long beam 24 is controlled by a pivot arm actuator cylinder 26. Extending downwardly and placed on the left portion and on the right portion of the long beam 24 is a dual wheel caster assembly 120 which includes an anti-wobble system. The anti-wobble system prevents wobbling of the caster wheels during a sweeping operation.

Figure 8:
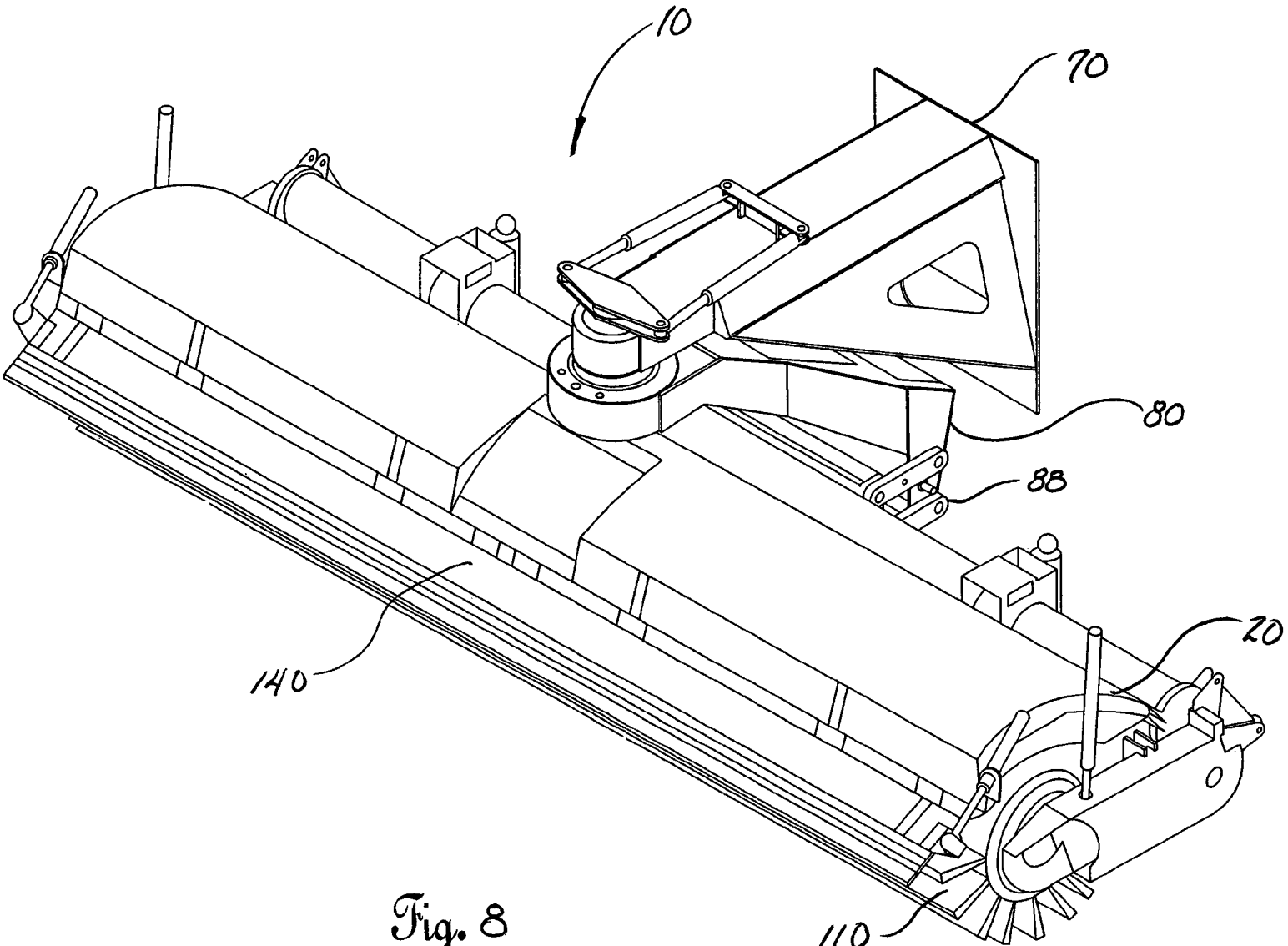
FIG. 8 is a perspective view of an alternate embodiment of the system illustrated in FIG. 1.

As shown in FIGS. 1 and 8, once the long cylindrical rotating broom 110 is mounted between the rotating pivot arms 32, the top of the long cylindrical rotating broom 110 may be enclosed with a cover assembly 130. Depending on the type of sweeping conditions encountered, the cover assembly 130 may include a directional flap for 132 directing snow or debris in a desired direction. An optional dump cover assembly 140 is shown in FIG. 8.

Those of ordinary skill in the art will now understand the assembly which positions the long rotating cylindrical broom and its drive mechanism such that they move effectively independently from the motion of the truck because of the four bar linkage connection between the floating beam assembly 90 and the swinging trunnion assembly 80. Up and down motion of either end of the rotating broom 110 is provided by the pivotable mounting of the long beam 24 to the floating beam assembly 90. Thus, any variation in terrain experienced by the tip of the broom bristles and transmitted back to the mounting for the broom results in movement of the floating beam assembly 90 and is not transmitted back to the truck chassis.

Rotation of rotating cylindrical broom assembly around its long axis is accomplished by one or more hydraulic motors located at the end of the rotating cylindrical broom, preferably in the broom pivot arm 32. Should up or down movement of either end of the rotating cylindrical broom 110 be required because of unusual terrain conditions, the hydraulic cylinders used to control the position of the broom pivot arms are actuated so that either end of the rotating broom 110 may be moved up or down. Angular positioning of the rotating broom 110 with respect to the chassis of the truck is controlled, as previously indicated, by swinging the trunnion assembly 80 with respect to the stationary gooseneck assembly 70. Such movement of the swinging trunnion assembly 80 will not affect the ability of the floating beam assembly 90 to move, thereby separating rotating broom movement from movement of the swinging trunnion assembly 80.

Utilization of rotating brooms having differing diameters is easily accomplished by removing the pivot arm 32 at the end of the long beam 24, removing the rotating broom 110, and replacing it with another rotating broom, and then replacing the broom pivot arm 32.

While the disclosed system has been described according to its preferred embodiment, those of ordinary skill in the art will understand that numerous other embodiments have been enabled by the foregoing disclosure. Such other embodiments shall be included within the scope and meaning of the appended claims.

What is claimed is:

1. A truck mounted rotating broom system comprising:

a support structure including:

a substantially stationary gooseneck assembly constructed and arranged to mount to the front of the truck; and a swinging trunnion assembly constructed and arranged for rotatable connection to said substantially stationary gooseneck assembly;

means for controlling the position of said swinging trunnion assembly with respect to said gooseneck assembly;

a non-load bearing connection including a floating beam assembly connected to the swinging trunnion assembly; and a broom positioning, supporting, and rotating assembly connected to said floating beam assembly and operable to have a rotating broom mounted thereto.

2. The system as defined in claim 1 wherein said non-load bearing connection includes a multiple link attachment mechanism.

3. The system as defined in claim 1 wherein the means for controlling the position of said swinging trunnion assembly comprises a steering yoke, a mounting bracket and a pair of steering cylinders connected there between.

4. The system as defined in claim 1 wherein the gooseneck assembly allows center point sweeping to the left or right of a truck to which the rotating broom system is mounted.

5. The system as defined in claim 1 wherein the swinging trunnion assembly provides center point oscillation of the broom positioning, supporting, and rotating assembly.

6. The system as defined in claim 1 wherein the broom positioning, supporting, and rotating assembly comprises a pair of caster wheel assemblies symmetrically positioned about the non-load bearing connection to support the weight of the broom positioning, supporting, and rotating assembly.

7. The system as defined in claim 1 wherein the point of rotation of the swinging trunnion assembly is located on the centerline of a chassis of a truck to which the rotating broom system is mounted.

8. The system as defined in claim 1 further comprising a substantially cylindrical rotating broom mounted to the broom positioning, supporting, and rotating assembly.

9. The system as defined in claim 8 wherein the rotating broom has a diameter ranging from about three to four feet and a length of about 18 feet.

* * * * *